US012427374B2

(12) United States Patent
Parsons et al.

(10) Patent No.: US 12,427,374 B2
(45) Date of Patent: Sep. 30, 2025

(54) ELECTRONIC VISUAL FEEDBACK SYSTEM AND METHOD OF USE FOR PILATES EQUIPMENT AND EXERCISES

(71) Applicants: Donna T. Parsons, Encinitas, CA (US); David J. Cline, Newport Beach, CA (US)

(72) Inventors: Donna T. Parsons, Encinitas, CA (US); David J. Cline, Newport Beach, CA (US)

( * ) Notice: Subject to any disclaimer, the term of this patent is extended or adjusted under 35 U.S.C. 154(b) by 402 days.

(21) Appl. No.: 17/371,004

(22) Filed: Jul. 8, 2021

(65) Prior Publication Data

US 2022/0008788 A1 Jan. 13, 2022

Related U.S. Application Data

(60) Provisional application No. 63/050,057, filed on Jul. 9, 2020.

(51) Int. Cl.
*A63B 24/00* (2006.01)
*A63B 21/00* (2006.01)

(52) U.S. Cl.
CPC ..... *A63B 24/0062* (2013.01); *A63B 21/4029* (2015.10); *A63B 2024/0068* (2013.01); *A63B 2208/0252* (2013.01); *A63B 2220/05* (2013.01); *A63B 2220/56* (2013.01)

(58) Field of Classification Search
CPC ..... A63B 24/0062; A63B 21/4029; A63B 2024/0068; A63B 2208/0252; A63B 2220/05; A63B 2220/56
See application file for complete search history.

(56) References Cited

U.S. PATENT DOCUMENTS

2010/0152004 A1* 6/2010 Feltz ..... A63B 22/16 482/142
2012/0233772 A1* 9/2012 Wang ..... A63B 21/4037 5/417
2017/0368413 A1* 12/2017 Shavit ..... A63B 24/0075

FOREIGN PATENT DOCUMENTS

CN 108211200 A * 6/2018
KR 200474605 Y1 * 9/2014 ..... A63B 17/04
KR 20200110485 A * 9/2020 ..... A63B 21/4037
KR 20210123177 A * 10/2021 ..... A61B 5/00
(Continued)

*Primary Examiner* — Loan B Jimenez
*Assistant Examiner* — Jacqueline N L Loberiza
(74) *Attorney, Agent, or Firm* — Larry K. Roberts

(57) ABSTRACT

An electronic system and method configured for use with an Pilates exercise equipment, such as Pilates equipment, having a surface supporting the exerciser during an exercise. The system includes a pressure sensitive matrix configured for fitting to the surface of the equipment, to measure pressures exerted by the exerciser on an area of the surface and provide electrical signals indicative of measured pressure values. A multiplexer/scanner is responsive to the electrical signals for collecting the measured pressure values. A processor responsive to the multiplexer output data signals interprets the data, resolves the data into discrete pressure values, assign a color value to each increment of pressure, and arrange the resolved data to a data format conforming to the position of each discrete pressure point on the area of the equipment. A display screen displays graphical images of the pressure values for the exerciser to view during exercise on the equipment.

22 Claims, 7 Drawing Sheets

(56) References Cited

FOREIGN PATENT DOCUMENTS

| | | | | |
|---|---|---|---|---|
| WO | WO-2015003211 A1 * | 1/2015 | ..... | A61B 5/1038 |
| WO | WO-2018009928 A1 * | 1/2018 | ..... | A43B 3/0005 |

* cited by examiner

ELECTRONIC VISUAL FEEDBACK SYSTEM AND METHOD OF USE FOR PILATES EQUIPMENT AND EXERCISES

BACKGROUND

This invention relates generally to the areas of training of human performance, improvement of human health, enhancing the effectiveness of training practice sessions, assisting coaches and trainers in evaluating clients, and reducing or eliminating the damage caused by repeatedly practicing mistakes.

The Pilates exercise system was developed by the German athlete Joseph Pilates in the early part of the 20th century. Using various forms of specialized exercises and equipment, and focusing on developing certain aspects of human musculature, Mr. Pilates created a new and highly successful method to improve the performance of athletes. Over the subsequent time following its introduction, and as the method became more widely practiced and accepted, it became apparent that these same techniques could be adopted by almost any individual, with highly beneficial results. Ultimately, a large body of science has become associated with the design of the required equipment, and a large number of professional practitioners have adopted his methods.

Focused on the core of the human body, the Pilates system seeks to develop, remedy, improve and intensify the stability and endurance of the entire human structure from within. Seeking a fundamental principle, Mr. Pilates addressed the core as the spinal column, pelvis, ribcage, scapulae and head with all muscular and connective tissue attachments. He arrived at the conclusion that human movement, be it walking, running, jumping, bending, stretching, crouching, etc., was ultimately anchored at the pelvis. Pelvic stability depends critically on the symmetry and strength of the entire core. Where such connection is missing or is unbalanced, the joints and adjacent muscles become overloaded, causing damage and overuse, while opposing or adjacent muscles become underloaded, creating asymmetry resulting in lack of strength and stability.

The origins of the Pilates method include eastern meditative forms of exercise along with western principles of strength training designed to guide the body and mind in a conscious and mindful method of moving. The Pilates System is comprised of 34 floor exercises (Matwork) that require a specific practiced sequence and 5 pieces of highly specialized equipment. The Universal Reformer, the Trapeze Table (Cadillac) and the Stability Chair (Wunda Chair) all include spring tension as a means of support and resistance. The Spine Corrector (Step Barrel) and Ladder Barrel are stationary curved surfaces to support and create articulation in the spine as well as strengthening the core. All pieces of equipment accommodate all planes of movement on all surfaces of the body. The system emphasizes slow, conscious management of the core musculature and adjacent limbs, isolating specific muscle groups and motions to develop strength, conscious control, symmetry and balance.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
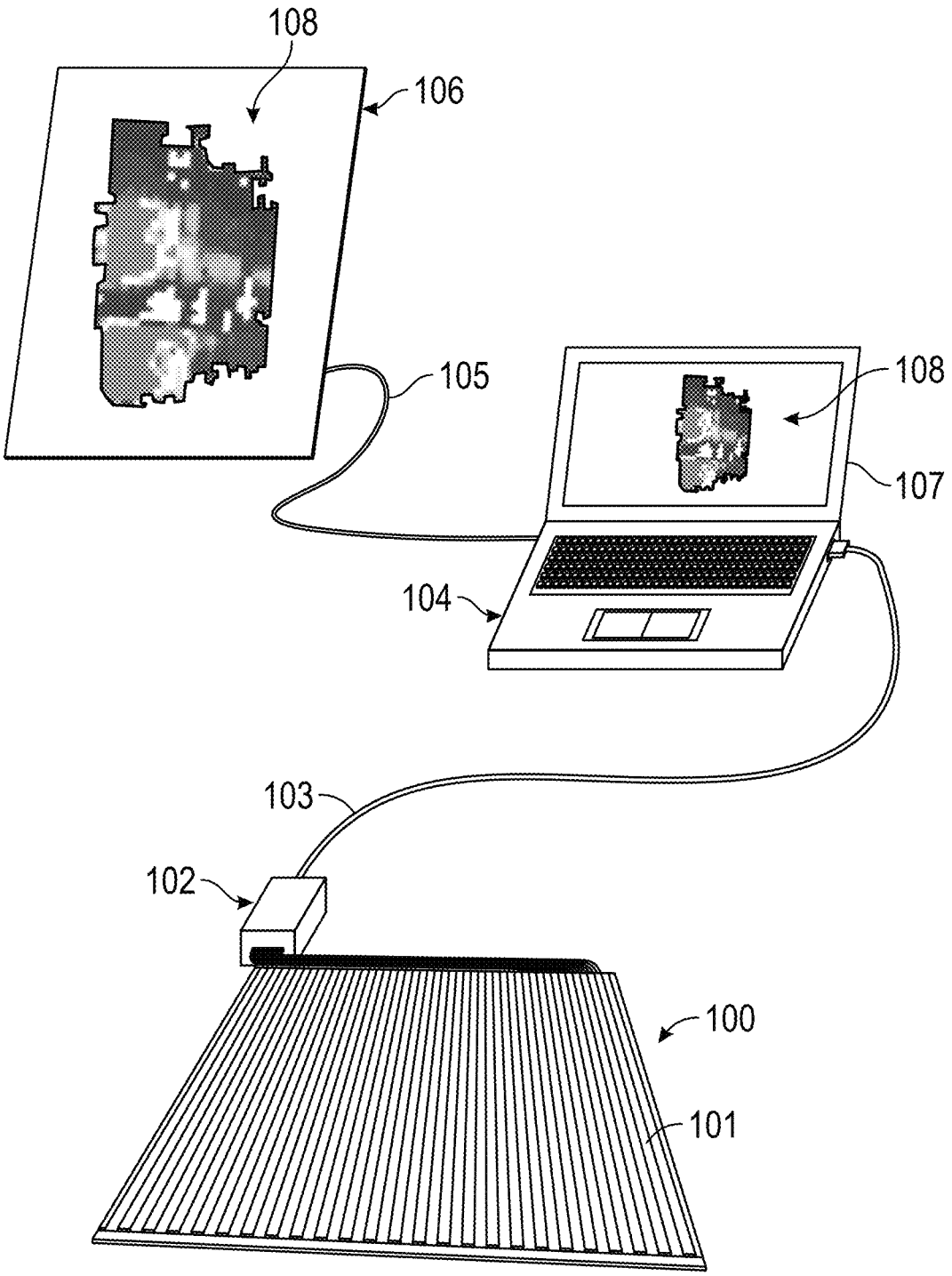
FIG. 1 is a depiction of an exemplary embodiment a pressure sensitive matrix with multiplexer, computer and visual display.

In the following detailed description and in the several figures of the drawing, like elements are identified with like reference numerals. The figures are not to scale, and relative feature sizes may be exaggerated for illustrative purposes.

Pilates trainers advance through numerous certification levels to achieve clarity and skill in the application of the Pilates method and science. It is mandatory that the principles of the system be followed rigidly to achieve the desired results. A trainer works through several means to guide the client/exerciser in achieving the desired result of balance and symmetry. Because of the design of the equipment and its complexity, results come through repeated training sessions, and accrue as the client learns how the equipment works, undoes prior damage and asymmetries, and builds the necessary strength in the appropriate muscle groups. These training sessions are most effective under the watchful eyes of a professional, and with constant feedback to reinforce success, presented verbally.

However, regardless of the skill of the trainer, certain aspects of the new musculature development may remain hidden, resulting in a less than optimum outcome, or in a plateau of progress that blocks further achievement. Although verbal feedback generally occurs in real time, it is based on the trainer's constant oversight of the exercise performance, a continuous coaching of what the client should be feeling or experiencing, and a verbal dialog based on the client's verbal description of their personal experience. Although critically dependent on the quality of the communication between trainer and client, each client experiences differently, due to the infinite variations in human physiology. The process could be likened to a blind person throwing darts. No matter how much dialogue occurs, the coach cannot provide the fine adjustments to consistently hit the bullseye of the target, because there is no fixed real-time frame of reference and instant feedback of success or error. Another example would be a person practicing piano, but no sound is produced when keys are struck. The student and the teacher are both observing the keys being depressed, but without the instant feedback of the sound. Real progress cannot be measured by the teacher or the student, although the movement seems right. If mistakes are being made, correcting may be extremely difficult or impossible. Consequently, the process of discovering, communicating, understanding and implementing the necessary changes can take too long to be of immediate use to the client/exerciser, who may be an elite athlete, who is in constant need of functional feedback to stay healthy and injury free so progress can be made.

With the forgoing examples in mind, it is an aspect of this invention to provide an innovative electronic visual display system and method to provide such a frame of reference via a real-time visual feedback to the client/exerciser and the trainer simultaneously. Activated during the performance of the training, a clear visual display of the results of each movement is provided. Where the execution of the exercise is displayed in real time, the trainer can articulate accurate analysis of all, or part, of a movement, make mid movement suggestions, or direct repetition of a small portion of a movement. With the immediate visual reinforcement of the progress of such movement, or lack thereof, the client can quickly achieve correct execution of the exercise. As the practice of mistakes over and over again is the most common error in performance training, the more quickly mistakes are corrected the more rapidly progress and satisfaction will be achieved.

The exemplary disclosed applications for this system and method are directed to the science of Pilates. The practice of Pilates includes several mechanical devices for the performance of exercises directed at the improvement of the human core. Among these are the Reformer, the Spine Corrector, and the Ladder Barrel. Each of these devices includes a surface against which the client rests, alternatively pressing and releasing in accordance with the particular exercise specifications. The Reformer has a horizontally moveable surface which supports the entire torso of the exerciser and allows exercises in the generally supine position. The Spine Corrector has a barrel shaped surface with an angled flat surface affixed thereto. The curved barrel shaped surface generally supports the lower back to the shoulder blades. The Ladder Barrel has a barrel shaped surface elevated from the floor, adjacent to which stands a series of ladder like rungs. The curved barrel shaped surface can support either the back or abdomen, with support being provided by the adjacent rungs. In addition, the portion of the anatomy which rests on, and presses against, said surfaces, can include the lower back, the mid back, the upper back, the sides, either left or right, and the abdomen.

To provide the direct visual feedback, in accordance with an aspect of the invention, the surfaces against which the client presses are provided with an array of electronic pressure sensors which are scanned by a multiplexer scanner, resolved into a graphic image, and displayed on a video screen configured to graphically represent the area of the equipment against which such pressure is applied. This display of pressure will take on specific patterns of pressure gradients, pressure intensity, and progress of movement, depending on the particular exercise being performed. Concurrent with the display of the pressure, the trainer observes the patterns, points out details to the client, and suggests/directs corrections or provides positive feedback. Using the guidance of the trainer, or in some cases by her or his self, the client can then begin to interpret the visual display of patterns, and in real-time rapidly progress in correct execution of the exercise.

The desired readout of pressures applied by the body of an exercising client requires a way of collecting applied pressure over a large area and resolving the applied pressure into discrete values. For instance, the distance between one measured pressure value and the next might be as small as, but not limited to, 5 mm and distant as, but not limited to, 20 mm. One exemplary system to accomplish this pressure collecting function includes a sensor such as a pressure sensitive membrane or film. Because of the varying areas of the human form which is measured, the dimensions of the pressure sensitive film can be as small as, but not limited to several square centimeters such as five square centimeters, or as large as, but not limited to, one square meter. For example, a TekScan BPMS 5315 utilizing a thin flexible pressure sensitive film, 48.77 cm×42.55 cm, with 2011 discrete points arranged as a rectangular matrix, and sensitive to pressure applied, paired with TekScan Evolution USB Handle and appropriate management and display software, is an appropriate option. The Handle is a multiplexer/scanner hardware that interfaces the pressure sensitive film, i.e. the sensor, to a computer such as a laptop, tablet or personal computer. The Handle in this example is bundled with software on a disk that is installed on the computer.

The flexible pressure sensitive membrane is mounted in a stress-free way to the hard surface of the Reformer carriage upper surface, beneath any cushion, and/or the curved surfaces of the Spine Corrector and/or the Ladder Barrel. In the interests of durability and safety, the surface of the pressure sensitive membrane might be covered with a thin, durable padding. Depending on the desire of the trainer or client/exerciser, any one or a plurality of Pilates training equipment might be so instrumented.

In use, the aggregated pressures measured by the thin flexible membrane are collected by the multiplexer and relayed to a computer/processor configured to interpret the scanned data, resolve the data into discrete pressure values, assign a visual value such as a color value to each increment of pressure, for example, black for lowest, red for highest, and arrange the data to conform to the position of each discrete pressure point on the surface of the equipment. This graphic display is then transmitted to a viewable display screen, arranged close to the client and in full view. This process is ideally updated at least 100 times per second, but may be less or more. In other embodiments, the visual value may be a gray-scale value, by way of example only.

FIG. 1 depicts a schematic of a typical data gathering and display electronic system for this invention. A membrane sensor 100 composed of pressure sensitive resistors 101 is illustrated. In a preferred embodiment, it may be 0.25 mm thick and is comprised of two flexible layers, each having one half of a resistive grid arranged at 90 degrees to each other, forming a matrix sandwich. When pressure is applied to the matrix sandwich, the junction of each resistive trace will have a resistance proportional to the pressure applied. The individual junctions can be ideally several hundred to several thousand. Connected to this resistive matrix is a multiplex scanner 102 which alternatively measures the resistive value of each junction, logging each according to its position in the grid. The speed of said scan can be 100 cycles per second, but can be as little as 1 per second or as high as 1000 per second. This scanned information is delivered via USB cable 103 to a computer 104 which has software installed which receives the scanned data, records it into a file, assigns a color to each pressure value, black for the lowest, red for the highest, and so on in between. These pressures can range from 0 psi to 10 psi, but are not limited to this range. Colors are then displayed on both the computer screen 107, and graphically transmitted via HDMI cable 105 to a larger monitor 106, and displayed for the user in a real-time moving image 108. The image 108 results from forces (not shown in FIG. 1) applied over the area of the structure 100. In this example, the sensor, multiplexer and software may be the commercially available Tekscan equipment described above. The electronic connections between the multiplexer and computer, and between the computer and the large monitor may alternatively be wireless, e.g. through WiFI or BlueTooth™.

Figure 2:
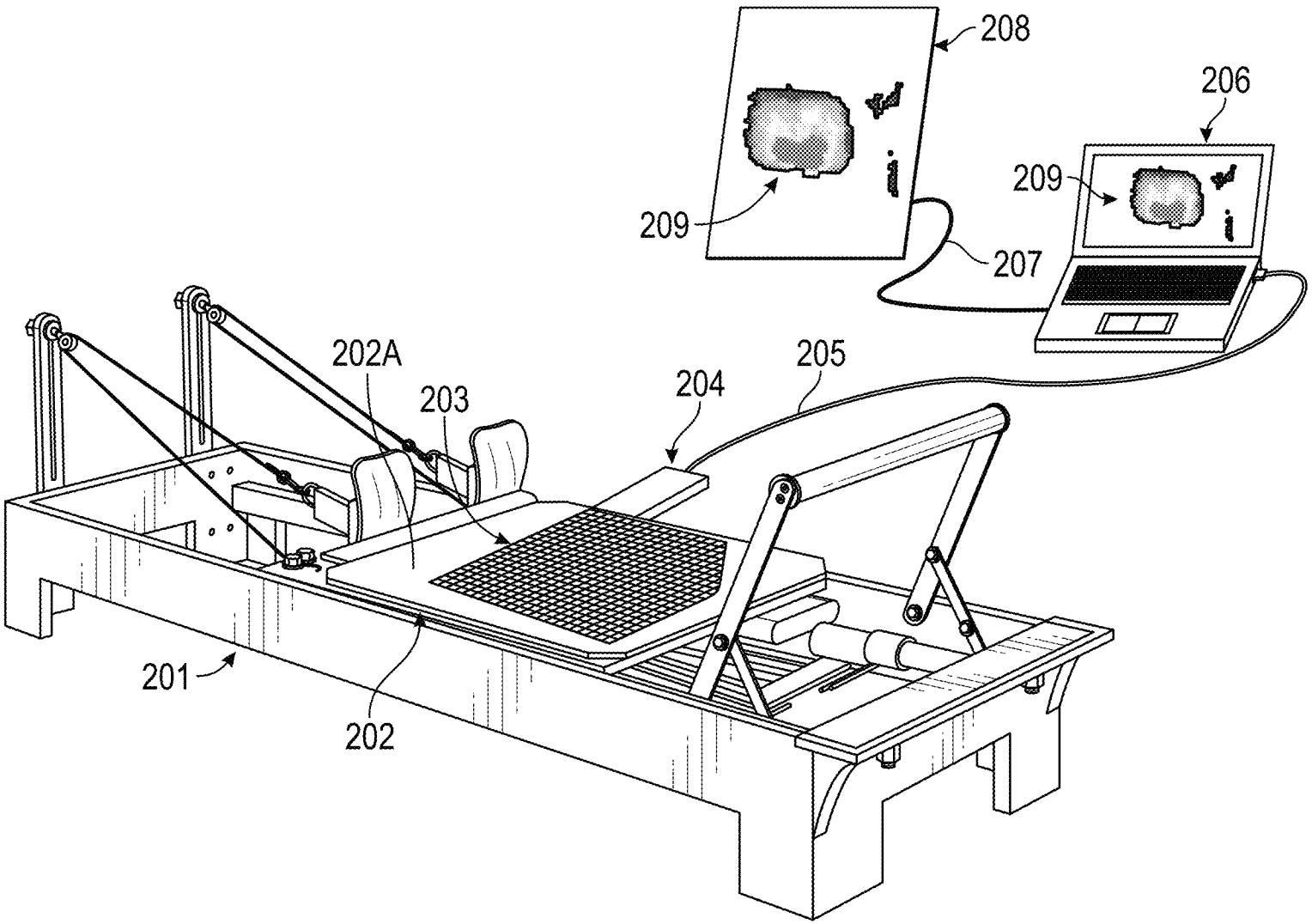
FIG. 2 is a depiction of an exemplary embodiment of a Reformer with a pressure sensitive matrix in accordance with an aspect of the invention.

FIG. 2 depicts a Pilates Reformer equipment 201, well known in the art of exercise. A component part of the reformer, the carriage 202, is identified. Placed on the top surface of the carriage is pressure sensitive membrane 203 preferably on a firm flat surface 202A of the carriage. The multiplex scanner 204, USB cable 205, computer 206, HDMI cable 207 and monitor 208 are identical to similar items shown in FIG. 1 and perform the same function. The monitor 208 is ideally situated as to be visible to the user of the Reformer and the coach so that immediate results 209 of the exercise actions can be viewed.

Figure 3:
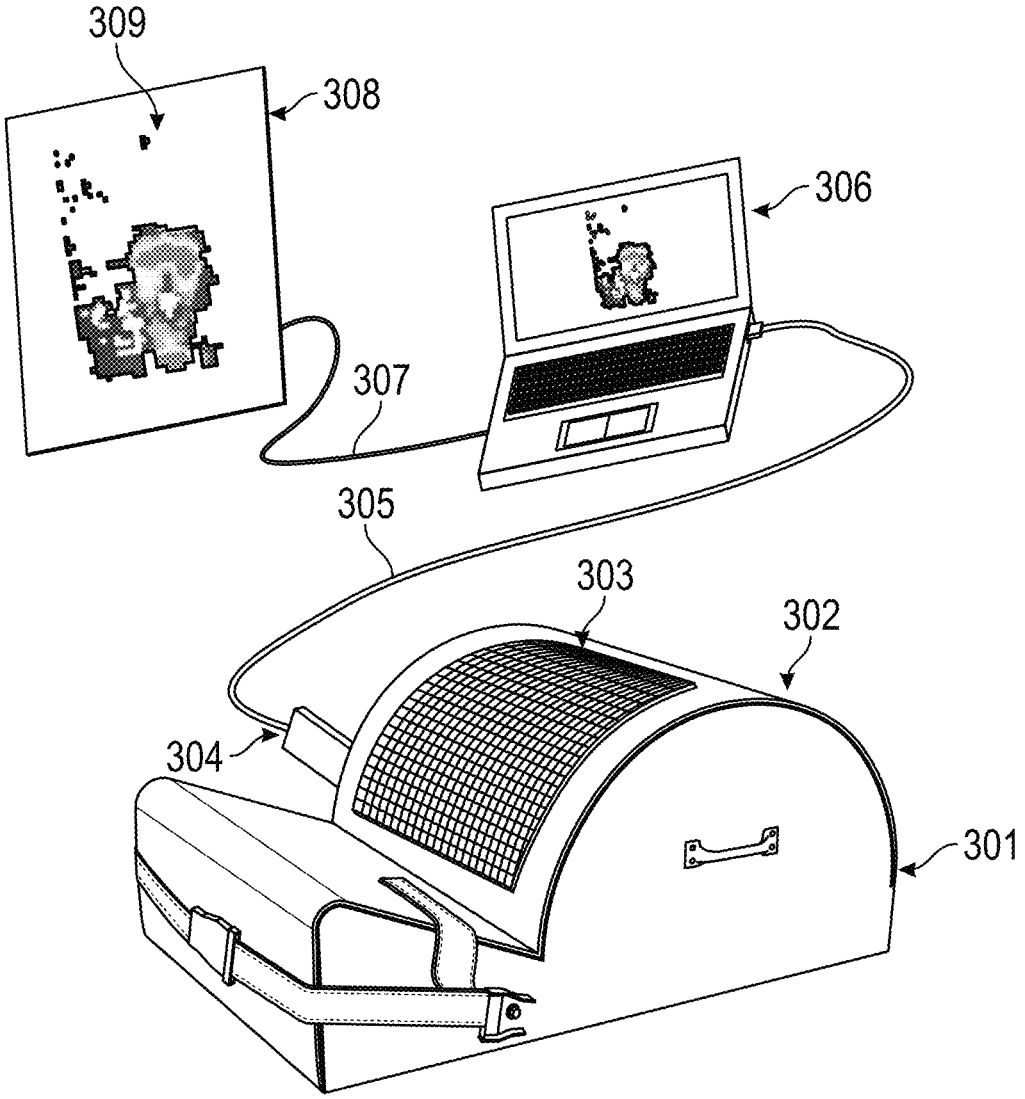
FIG. 3 is a depiction of an exemplary embodiment of a Spine Corrector with a pressure sensitive matrix in accordance with an aspect of the invention.

FIG. 3 is a depiction of a Spine Corrector 301. A portion of the upper curved surface 302 of the spine corrector is fitted with a pressure sensitive membrane 303, which conforms to the upper curved surface. The multiplex scanner 304, USB cable 305, computer 306, HDMI cable 307, are identical to similar items shown in FIG. 1 and perform the same function. The monitor 308 is ideally situated as to be visible to the user of the Spine Corrector and the coach so that immediate results 309 of the exercise actions can be viewed.

Figure 4:
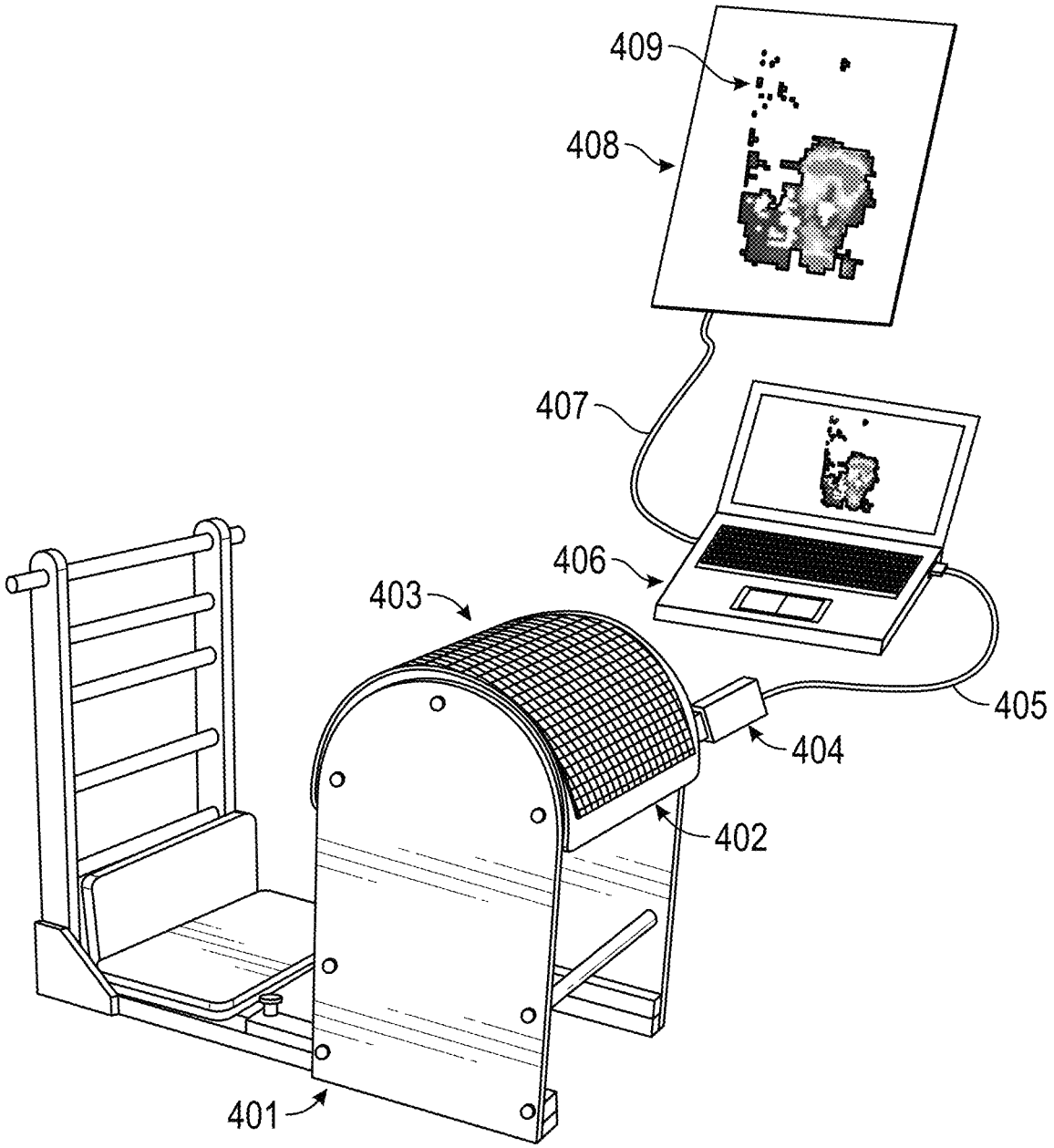
FIG. 4 is a depiction of an exemplary embodiment of a Ladder Barrel with a pressure sensitive matrix in accordance with an aspect of the invention.

FIG. 4 is depiction of a Ladder Barrel 401. The upper curved surface 402 of the Ladder Barrel is fitted with a pressure sensitive membrane 403, which conforms to the upper curved surface.

The multiplex scanner 404, USB cable 405, computer 406, HDMI cable 407, and monitor 408 are identical to similar items shown in FIG. 1 and perform the same function. The monitor 408 is ideally situated as to be visible to the user of the Ladder Barrel and the coach so that immediate results 409 of the exercise actions 409 can be viewed.

Figure 5:
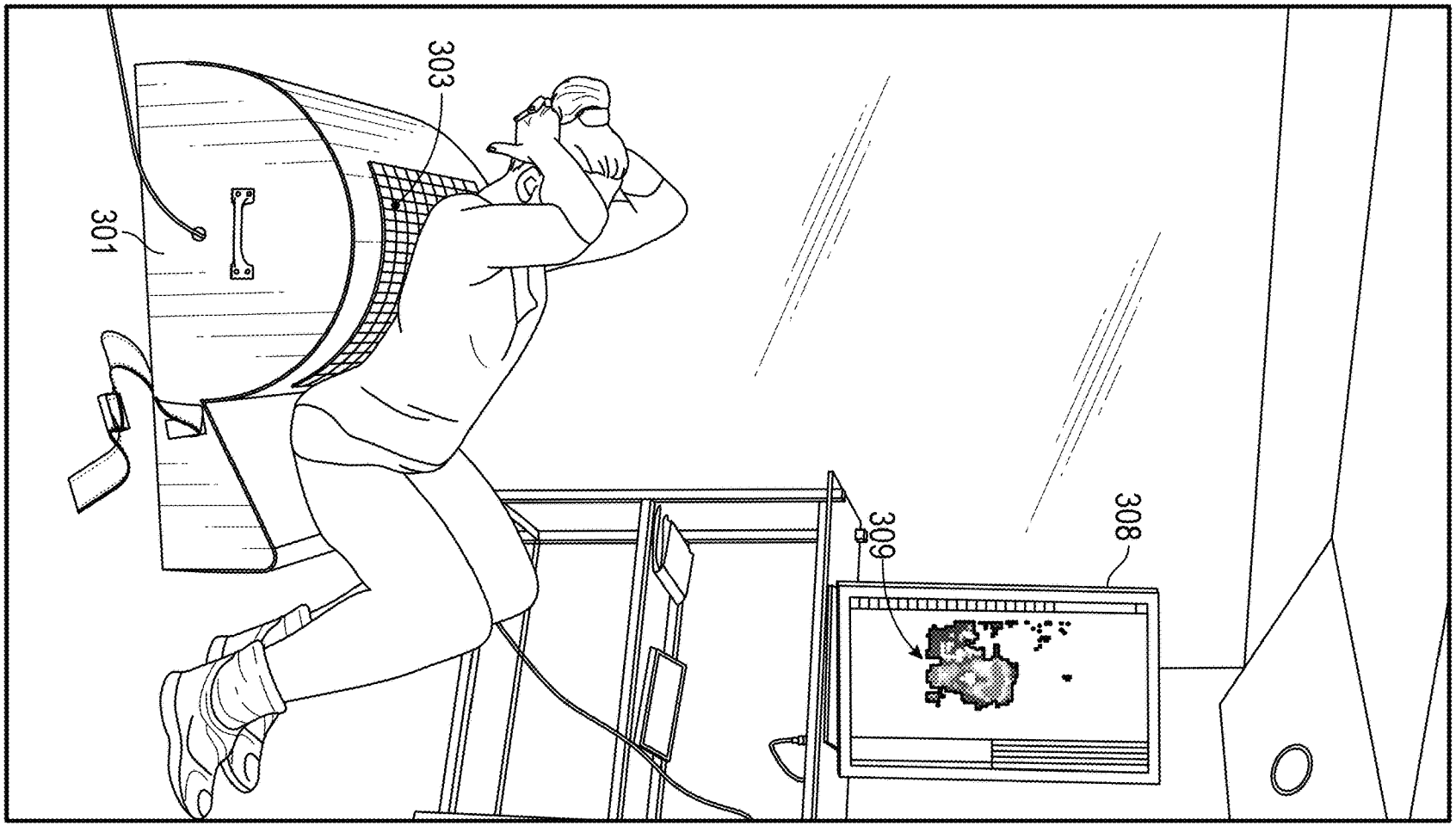
FIG. 5 is a depiction of a typical use of a Reformer with a graphic display in accordance with an aspect of the invention.

FIG. 5 is a pictorial depiction of a typical user working with the Spine Corrector 301 equipped with an electronic visual display system as described above regarding FIGS. 1 and 3, including pressure sensor 303, monitor 308, to display pressure results 309 to the user.

Figure 6:
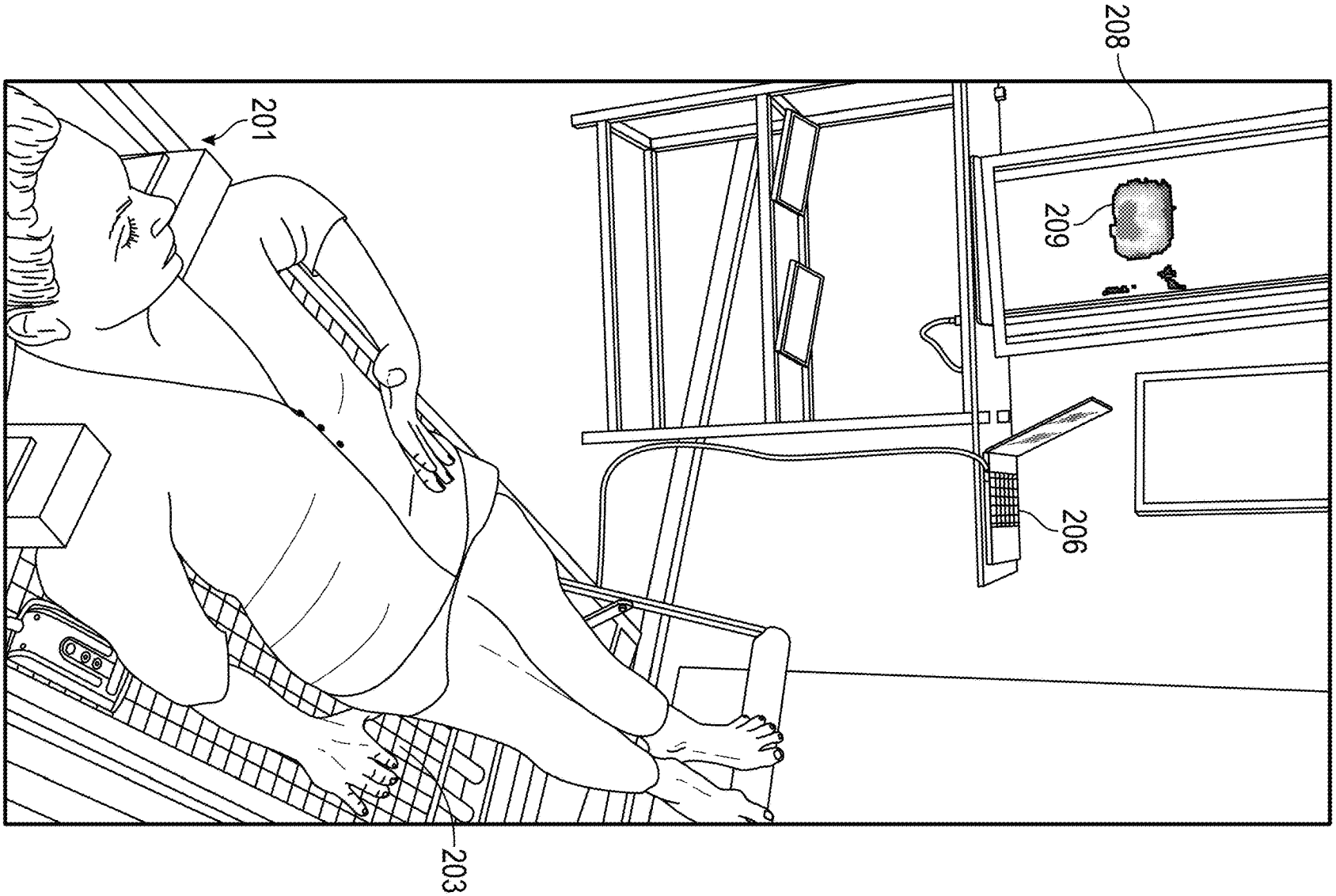
FIG. 6 is a depiction of a typical use of a Spine corrector with a graphic display in accordance with an aspect of the invention.

FIG. 6 is a pictorial depiction of a typical user working with a Reformer equipped with an electronic visual display system, as described above regarding FIGS. 1 and 2, including pressure sensor 203, computer 206, monitor 208, to display pressure results 209 to the user.

Figure 7:
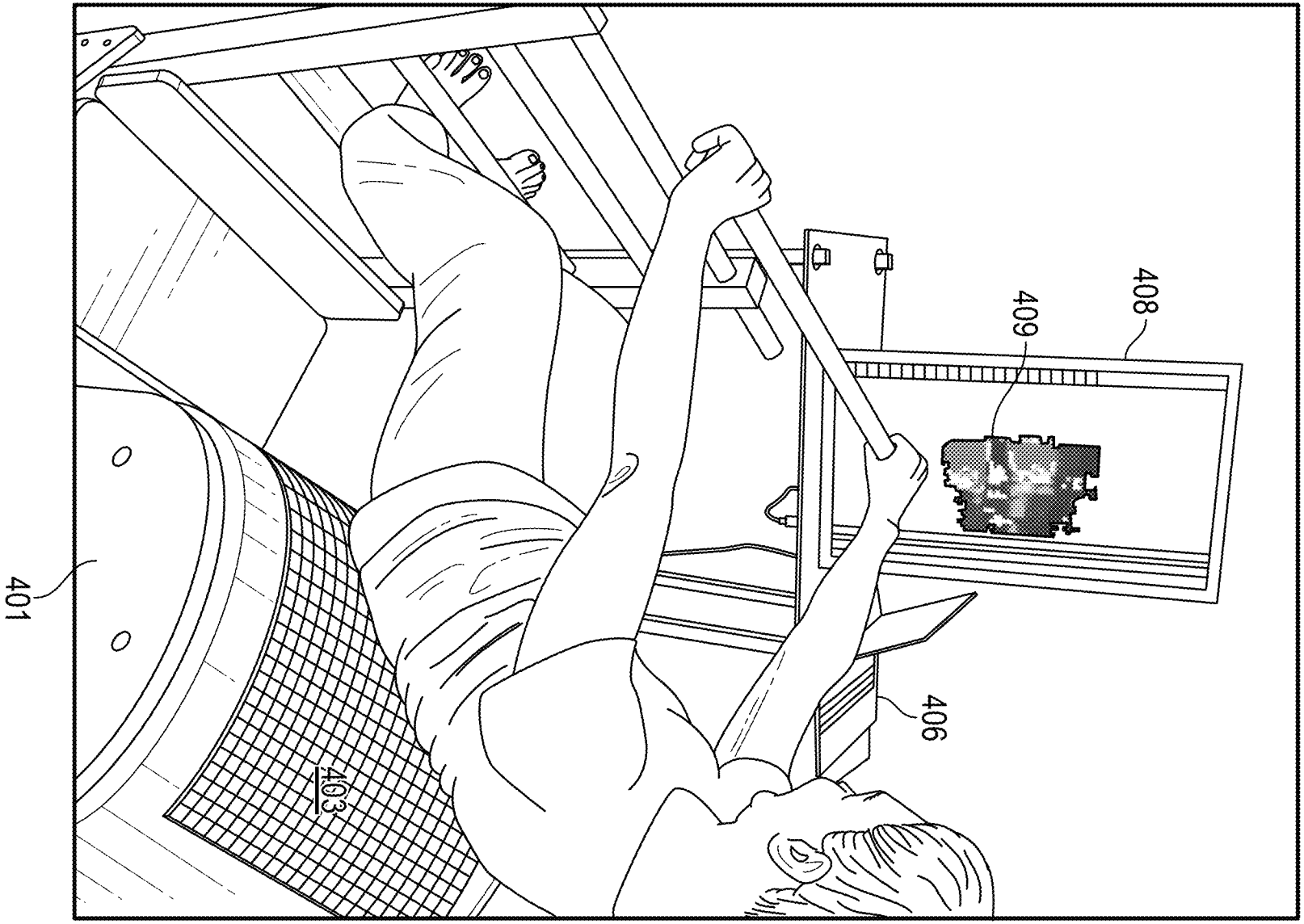
FIG. 7 is a depiction of a typical use of a Ladder Barrel with a graphic display in accordance with an aspect of the invention.

FIG. 7 is a depiction of a typical use of a Ladder Barrel equipment 401, with an electronic graphic display as described above regarding FIGS. 1 and 4, including pressure sensor 403, computer 406 and monitor 408, to display pressure results 409 to the user.

The pressure data gathering and display electronic system may be marketed as sold as a component of the exercise equipment when new, or as a system which can be installed on an existing exercise equipment installation. While an intended use of the system is for Pilates equipment, the system may also be used with other exercise equipment.

Although the foregoing has been a description and illustration of specific embodiments of the subject matter, various modifications and changes thereto can be made by persons skilled in the art without departing from the scope and spirit of the invention.

What is claimed is:

1. An electronic visual display system for displaying pressure results of an exerciser's contact with a surface of a Pilates equipment, comprising:

a thin pressure sensitive layer having a matrix of pressure sensors, the pressure sensitive layer fitted to the surface of the Pilates equipment, the Pilates equipment one of a Pilates reformer equipment having a horizontally moveable surface which supports the entire torso of the exerciser and allows exercises in a generally supine position, a Pilates spine corrector equipment having a curved barrel shaped surface with an angled flat surface affixed thereto, and a Pilates ladder barrel equipment having a barrel shaped surface elevated from the floor, adjacent to which stands a series of ladder-like rungs, each pressure sensor configured to measure pressures exerted by the exerciser on an area of the Pilates equipment surface and provide electrical signals indicative of measured pressure values over the area of the Pilates equipment surface;

a multiplexer scanner responsive to the electrical signals for collecting said measured pressure values and providing multiplexer output data signals representing the measured pressure values over the area of the Pilates equipment surface;

a processor responsive to the multiplexer output data signals to interpret the data, resolve the data into discrete pressure values, assign a value to each increment of pressure, and arrange the resolved data to a data format conforming to the position of each discrete pressure point on the area of the Pilates equipment surface;

a display screen arranged in view of the exerciser and a certified Pilates trainer and responsive to data from the processor to display graphical real-time moving images of said pressure values for the exerciser and certified Pilates trainer to view and receive real-time visual feedback of the results of each movement during exercise on said Pilates equipment.

2. The system of claim 1, wherein the respective values assigned to each increment of pressure are color values.

3. The system of claim 2, wherein the color values assigned to each increment of pressure include black for lowest pressure and red for highest pressure, and the data are arranged to conform to the position of each discrete pressure point on the surface of the equipment.

4. The system of claim 1, wherein the area of the surface is in a range of five square centimeters and one square meter.

5. The system of claim 1 wherein the pressure sensitive layer is a thin pressure-sensitive membrane, the pressure sensors of the matrix of pressure sensors are spaced apart from adjacent sensors by a range of 0.5 mm to 20 mm.

6. The system of claim 1, wherein the Pilates equipment is the Pilates reformer equipment, and the matrix of pressure sensors is supported on the horizontally movable surface to capture pressure data of pressure between the torso and the movable surface.

7. The system of claim 1, wherein the Pilates equipment is the Pilates spine corrector equipment wherein the Pilates equipment is the Pilates ladder barrel equipment, the barrel shaped surface configured to generally support an exerciser's lower back to the shoulder blades;

the matrix of pressure sensors is fitted to the curved barrel shaped surface, the pressure sensors configured to measure pressures exerted by the exerciser on an area of the surface and provide electrical signals indicative of measured pressure values over the area.

8. The system of claim 1, wherein the Pilates equipment is the Pilates spine corrector equipment wherein the Pilates equipment is the Pilates ladder barrel equipment, the barrel shaped surface configured to support either the back or abdomen, with support being provided by the adjacent rungs;

the matrix of pressure sensors fitted to the barrel shaped surface of the equipment, the pressure sensors configured to measure pressures exerted by the exerciser on an area of the barrel shaped surface and provide electrical signals indicative of measured pressure values over the area.

9. A method of using the system of claim 1, comprising:

performing an exercise using the Pilates equipment;

displaying on the display screen and graphically representing the area of the equipment against which pressure is applied by the exerciser's body against the surface by displaying said pressure values graphically in real-time moving images;

making mid-movement corrections in response to the real-time moving images and guidance from the certified Pilates trainer to achieve correct execution of the exercise.

10. A Pilates exercise system, comprising:

a Pilates equipment having a surface configured for contact by an exerciser's body during a Pilates exercise, the Pilates equipment one of a Pilates reformer equipment having a horizontally moveable surface which supports the entire torso of the exerciser and allows exercises in a generally supine position, a Pilates spine corrector equipment having a curved barrel shaped surface with an angled flat surface affixed thereto, and a Pilates ladder barrel equipment having a barrel shaped surface elevated from the floor, adjacent to which stands a series of ladder-like rungs;

an electronic visual display system for displaying pressure results of an exerciser's contact with the surface of the Pilates equipment, comprising:

a thin pressure-sensitive membrane or film having a matrix of pressure sensors, the pressure sensor membrane or film fitted to the surface of the Pilates equipment, the pressure sensor membrane or film configured to measure pressures exerted by the exerciser on an area of the surface and provide electrical signals indicative of measured pressure values over the area of the surface;

a multiplexer scanner responsive to the electrical signals for collecting said measured pressure values and providing multiplexer output data signals representing the measured pressure values over the area surface;

a processor responsive to the multiplexer output data signals to interpret the data, resolve the data into discrete pressure values, assign a value to each increment of pressure, and arrange the resolved data to a data format conforming to the position of each discrete pressure point on the area of the surface;

a display screen arranged in view of the exerciser and a certified Pilates trainer and responsive to data from the processor to display graphical real-time moving images of said pressure values for the exerciser and certified Pilates trainer to view and receive real-time visual feedback of the results of each movement during exercise on said equipment.

11. The Pilates exercise system of claim 10, wherein:

the Pilates equipment is the Pilates reformer equipment, and the pressure-sensitive membrane is supported on the horizontally movable surface and configured to capture pressure data of pressure between the torso and the movable surface.

12. The system of claim 10, wherein:

the Pilates equipment is the Pilates spine corrector equipment;

the pressure-sensitive membrane is fitted to the curved barrel shaped surface and configured to measure pressures exerted by the exerciser on an area of the surface and provide electrical signals indicative of measured pressure values over the area.

13. The system of claim 10, wherein:

the Pilates equipment is the Pilates ladder barrel equipment;

the pressure-sensitive membrane fitted to the barrel shaped surface of the equipment, the pressure-sensitive membrane configured to measure pressures exerted by the exerciser on an area of the barrel shaped surface and provide electrical signals indicative of measured pressure values over the area.

14. The system of claim 10, wherein the respective values assigned to each increment of pressure are color values.

15. The system of claim 14, wherein the color values assigned to each increment of pressure include black for lowest pressure and red for highest pressure, and the data are arranged to conform to the position of each discrete pressure point on the surface of the equipment.

16. The system of claim 10, wherein the area of the surface is in a range of five square centimeters and one square meter.

17. The system of claim 10 wherein the pressure sensors of the matrix of pressure sensors are spaced apart from adjacent sensors by a range of 0.5 mm to 20 mm.

18. A method of using the system of claim 10, comprising:

performing an exercise using the Pilates equipment;

displaying on the display screen and graphically representing the area of the equipment against which pressure is applied by the exerciser's body against the surface by displaying said pressure values graphically in real-time moving images;

making mid-movement corrections in response to the real-time moving images and guidance from the certified Pilates trainer to achieve correct execution of the exercise.

19. A method of using a Pilates equipment, comprising:

fitting a thin pressure sensitive membrane having a matrix of pressure sensors disposed over a membrane area to a surface of the Pilates equipment, the thin membrane configured to respond to pressures exerted by an exerciser on the area and provide electrical signals indicative of measured pressure values over the membrane area, the Pilates equipment consisting of one of a Pilates reformer equipment having a horizontally moveable surface which supports the entire torso of the exerciser and allows exercises in a generally supine position, a Pilates spine corrector equipment having a curved barrel shaped surface with an angled flat surface affixed thereto, and a Pilates ladder barrel equipment having a barrel shaped surface elevated from the floor, adjacent to which stands a series of ladder-like rungs;

performing a Pilates exercise using the Pilates equipment, wherein the exerciser's body applies pressure to the membrane and underlying Pilates equipment surface;

scanning the electrical signals for collecting and providing multiplexed output data signals indicative of the measured pressure values over the membrane area;

processing the multiplexed output data signals to interpret the data, resolve the data into discrete pressure values, assign a value to each increment of pressure, and arrange the resolved data to a data format conforming to the position of each discrete pressure point on the membrane area;

positioning a display screen in view of the exerciser and a certified Pilates trainer, the display screen responsive to the resolved data to display graphical real-time moving images of said pressure values for the exerciser and certified Pilates trainer to view and receive real-time visual feedback of the results of each movement during exercise on said equipment, the images graphically representing the area of the equipment against which pressure is applied by the exerciser's body against the surface and displaying said pressure values graphically;

making mid-movement corrections in response to the real-time moving images and guidance from the certified Pilates trainer to achieve correct execution of the Pilates exercise and improve the exerciser's core.

20. The method of claim 19, wherein:

the Pilates equipment is the Pilates reformer equipment, and the pressure-sensitive membrane is supported on the horizontally movable surface to capture pressure data of pressure between the exerciser's torso and the movable surface.

21. The method of claim 19, wherein:

the Pilates equipment is the Pilates spine corrector equipment;

the pressure-sensitive membrane is fitted to the curved barrel shaped surface, the pressure-sensitive membrane configured to measure pressures exerted by the exerciser on an area of the surface and provide electrical signals indicative of measured pressure values over the area.

22. The method of claim 19, wherein:

the Pilates equipment is the Pilates ladder barrel equipment; and the pressure-sensitive membrane is fitted to the barrel shaped surface of the equipment, the pressure-sensitive membrane configured to measure pressures exerted by the exerciser on an area of the barrel shaped surface and provide electrical signals indicative of measured pressure values over the area.

* * * * *